US008007418B2

(12) United States Patent
LeVert et al.

(10) Patent No.: US 8,007,418 B2
(45) Date of Patent: Aug. 30, 2011

(54) PORTABLE RESISTANCE TRAINING DEVICE

(76) Inventors: Gerald C. LeVert, Memphis, TN (US); Lisa A. LeVert, Washington, DC (US); Francis E. LeVert, II, Atlanta, GA (US); Francis E LeVert, Knoxville, TN (US)

( * ) Notice: Subject to any disclaimer, the term of this patent is extended or adjusted under 35 U.S.C. 154(b) by 0 days.

(21) Appl. No.: 12/454,249

(22) Filed: May 15, 2009

(65) Prior Publication Data

US 2010/0292053 A1 Nov. 18, 2010

(51) Int. Cl.
*A63B 21/008* (2006.01)

(52) U.S. Cl. ..... 482/112

(58) Field of Classification Search ..... 482/111–113, 482/53, 58, 128
See application file for complete search history.

(56) References Cited

U.S. PATENT DOCUMENTS

| | | | | | |
|---|---|---|---|---|---|
| 767,008 | A * | 8/1904 | Pelletier et al. | ..... | 482/112 |
| 3,174,343 | A * | 3/1965 | Kasulis | ..... | 482/112 |
| 4,951,941 | A * | 8/1990 | Resk | ..... | 482/112 |
| 5,069,448 | A * | 12/1991 | Shyu | ..... | 482/112 |
| 5,529,559 | A * | 6/1996 | Punzalan | ..... | 482/112 |
| 5,906,565 | A * | 5/1999 | Wasserman et al. | ..... | 482/112 |
| 6,468,190 | B1 * | 10/2002 | Fazio et al. | ..... | 482/112 |
| 7,163,495 | B2 * | 1/2007 | Fazio et al. | ..... | 482/112 |
| 7,517,306 | B2 * | 4/2009 | Fisher et al. | ..... | 482/112 |

* cited by examiner

*Primary Examiner* — Fenn C Mathew

(57) ABSTRACT

A portable resistance training apparatus for use in exercise routines is described in this patent application. According to the principles of the embodiments of the present invention, a portable resistance training device comprising: an integral elongated cylindrical unit capable of accepting a piston for doing work on a compressible fluid where the force to drive the piston is supplied from without; an elongated rod whose movement is controlled by adduction or abduction exercise routines; valve means for controlling the flow of air from the internal volume of the cylindrical unit thereby controlling the amount of force supplied by the user, and monitoring means for safe training.

4 Claims, 2 Drawing Sheets

PORTABLE RESISTANCE TRAINING DEVICE

CROSS REFERENCE OF RELATED APPLICATIONS

Pursuant to 35 U.S.C. 119 the benefit of priority from Provisional Application No. 61/127,181 with filing dare May 12, 2008 is claimed for this Non-Provisional Application.

TECHNICAL FIELD OF THE INVENTION

The present invention relates generally to resistance training devices.

BACKGROUND AND OBJECTIVES OF THE INVENTION

Positive resistance training devices vary from fixed position home gym systems; resistance chairs, resistance plates, resistance bands, mechanical spring and air filled spring based fixed units. A portable resistance training apparatus for use in exercise routines is described in this invention patent application. One of the objectives of this invention is to provide a portable resistance training device (RTD) where the magnitude of the force required to promote improved conditioning can be changed without recourse to additions of different weights or implements with different physical properties or complex physical adjustments. A second objective is to provide a RTD that can be used in adduction/abduction and rowing exercises. Other objectives will become apparent during the course of the detailed description The portable resistance training device is designed to be used to maintain the healthy condition of portions of a user's body though resistance training.

SUMMARY OF THE INVENTION

In light of the need for a portable resistance training device for use in exercise routines where the magnitude of adduction and abduction forces required to promote conditioning can be changed without recourse to the addition of different weights or implements, the objective of this invention is to provide a resistance training device which: is light weight, portable and inexpensive; and, has easy selectable resistance over a wide range of magnitude adjustability. The subject invention accomplishes these and other objectives relative to standard adduction and abduction exercises for the chest, abdomen, arms and legs. The above and other objectives, features and advantages of the subject invention will become apparent to those knowledgeable in the fitness area.

BRIEF DESCRIPTION OF THE FIGURES

1)

2)

DETAILED DESCRIPTION OF THE DEVICE OF THIS INVENTION

Figure 1:
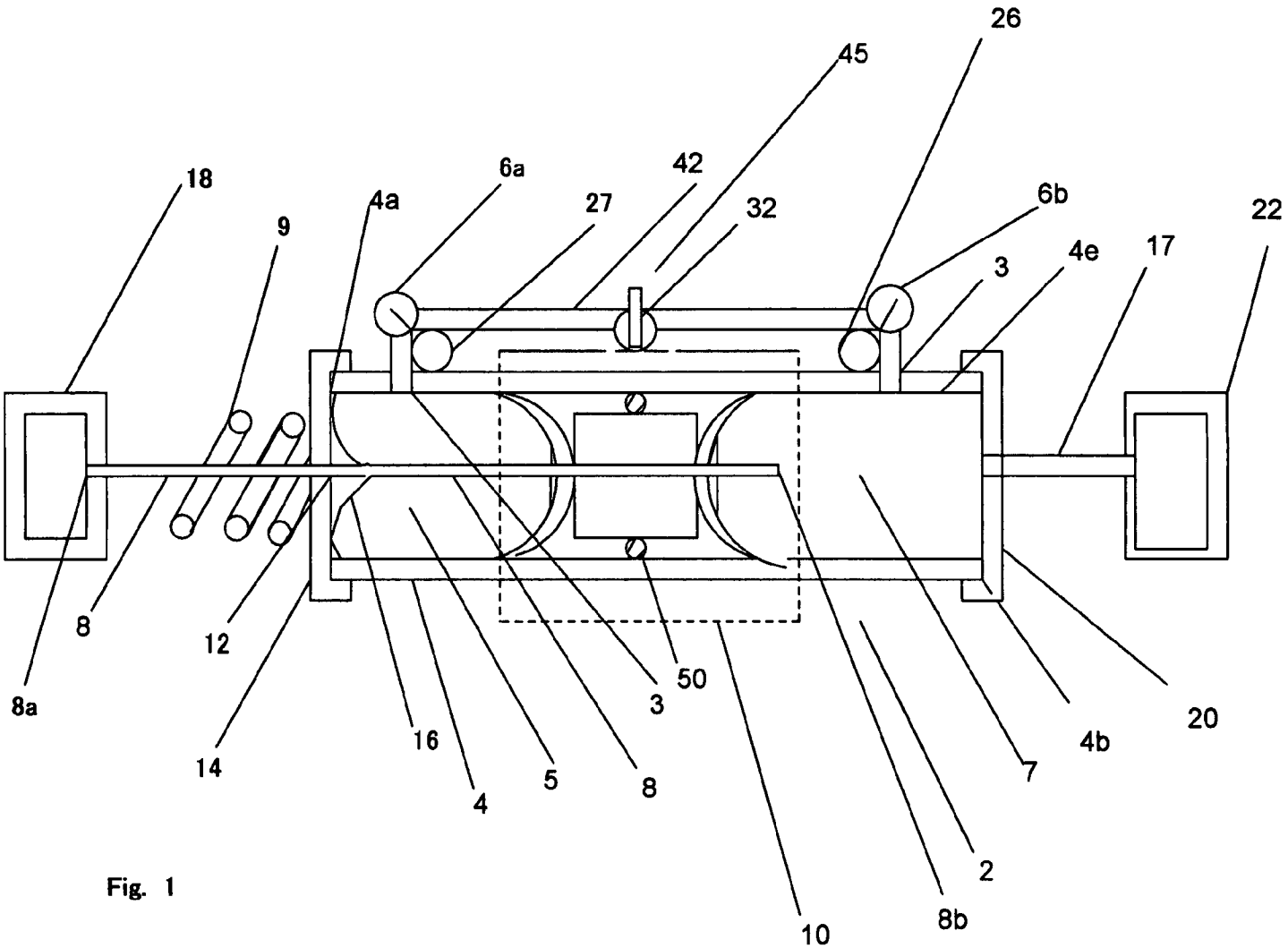
FIG. 1 shows a schematic view of the resistance training device of this invention.

The RTD of this invention is denoted generally by the numeral 2 in FIG. 1. In accordance with the first aspect of this invention a resistance exercise device comprising: chamber 4 and including a first end 4*a*, a second end 4*b* and an inner surface 4*e*; piston assembly 10, end caps 14 and 20 mechanically attached to the first and second ends of chamber 4, respectively, adjustable valves 6*a* and 6*b* connected proximate the first end 4*a* and the second end 4*b*, respectively; and, ordinary tubular nipples 3 which are attached to chamber 4 at both of its terminal ends The tubular nipple 3 located next to end cap 20, allows the escape of fluid from the chamber 4 when piston assembly 10 is moved forcibly toward end cap 20 via piston rod 8 having a first terminal end 8*a* and a second terminal end 8*b* attached to piston assembly 10 such that the piston assembly is slidably received by chamber 4. The piston assembly 10 separates chamber 4 into a first chamber section 5 which includes first end 4*a* and second chamber section 7 chamber 4, which includes second end 4*b*. The piston assembly 10 essentially blocks the fluid communication between the dual volumes here called chamber section 5 and chamber section 7. This concatenated system of air filled volumes are an essential element of the subject invention.

The first terminal end 8*a* of the piston rod 8 extends out of the first end 4*a* of the chamber 4 though throughhole 12 in end cap 14 which is attached to the first end 4*a* of the chamber 4; the throughhole 12 having a flexible member 16 that circumscribes throughhole 12 that allows the translational movement of the piston rod 8 though throughhole 12 in end cap 14. The throughhole 12 opening allows the aforementioned translational movement of the piston rod 8 while essentially maintaining a minimal fluid leakage and frictional wear therebetween during the retraction and insertion of the piston assembly 10. The first terminal end 8*a* of the piston rod 8 having a handle 18 attached thereto for enabling the insertion and retraction of piston assembly 10, The rotational center of the handle 18 is collinear with the axial center of the piston rod 8 and that of the piston assembly 10. The chamber section 7 of chamber 4 is closed at its second end 4*b* in a non fluid leakage manner with end cap 20, rigidly attached to second handle 22 via fixed rod 17. Second handle 22 is linearly disposed along a line that is collinear with the first handle 18. A gauge 26 interposed between valve 6*b* and nipple 3 via ordinary non porous tubing, the gauge 26 being calibrated to read pound force/inch or Newton's in direct relationship to the extraction/insertion of the essentially linearly acting forces applied by the user of the RTD. By varying the size of the orifices in valves 6*a* and 6*b*, the user can personalize the force needed to drive the piston against the resisting force of the air in the chamber sections being compressed or undergoing rarefaction. As the air is being compressed, for example in chamber 7, the air in chamber 5 is undergoing rarefaction as its volume grows. Returning to valve 6*b*, the output thereof is directed to diverter valve 32 where the output of valve 6*a* may be pumped to the atmosphere 45 or into chamber section 5 depending on the position of orifices in diverter valve 32. As stated above the compressed air flowing through valve 6*b* into diverter valve 32 where it can be exhaust to the atmosphere denoted by the numeral 45 or into valve 6*a* via tube 42 and into volume section 5 via the nipple 3 located proximate end cap 14 of chamber 4 at a flow rate that is determined by on the status of the orifice of valve 6*a* and that of 6*b* depending on the status of valve 6*b* and nipple 43. Spring limiter 9 provides some return force on the piston assembly at the end of the insertion stroke of piston assembly 10.

Figure 2:
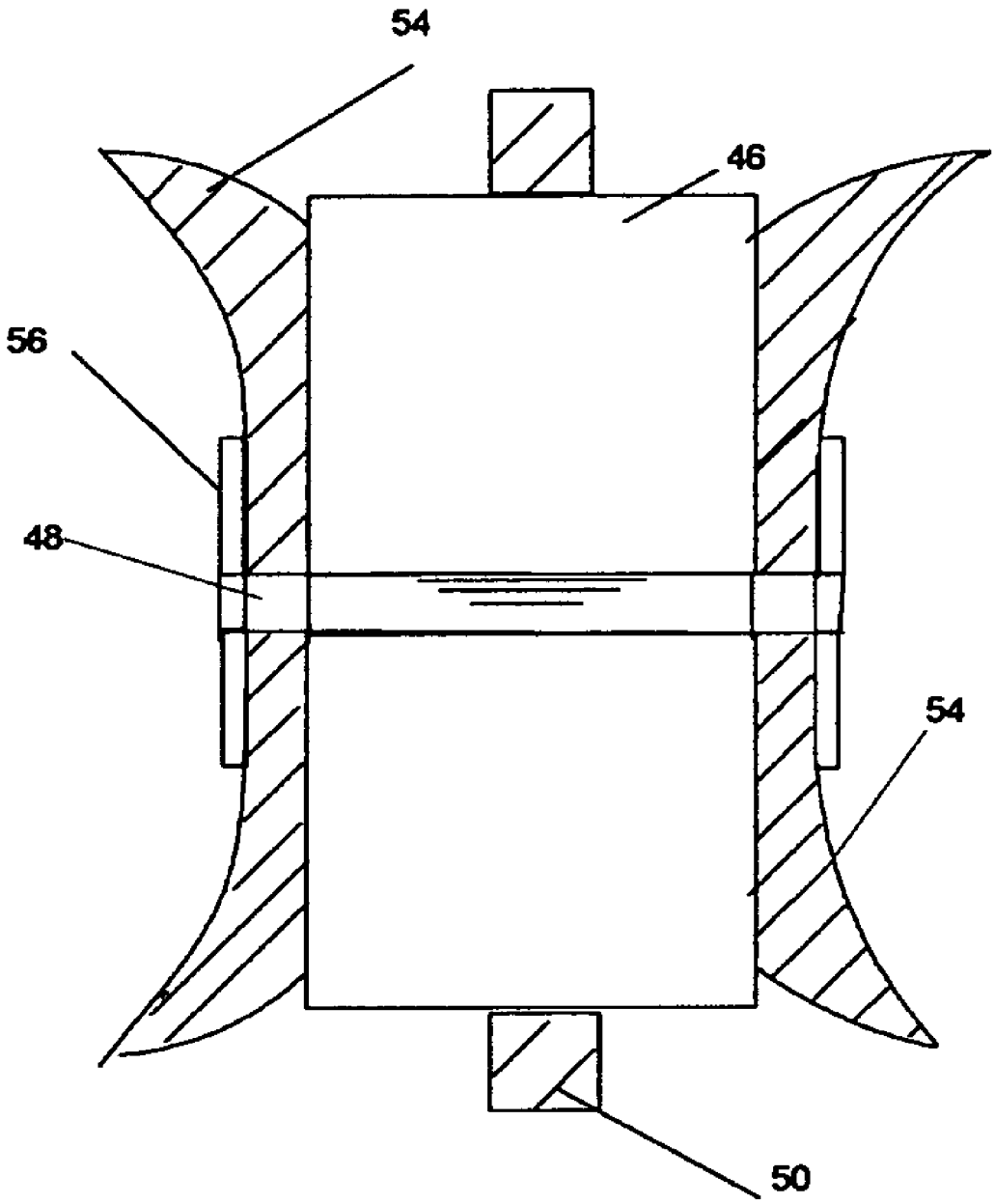
FIG. 2 shows an enlarged drawing of the piston assembly of the invention of FIG. 1.

FIG. 2 shows an enlarged view of piston assembly 10. The piston assembly 10 comprises: disc 46 with throughhole 48; cylindrical disc 50 which is made of low friction material that essentially reduces the frictional wear between the inner surface 4*e* of chamber 4; cup-shaped membrane member 52 and 54; washers 56 and 57 and mating nuts 58 (not shown in FIG. 2) for fixing the position of piston assembly 10 on piston rod 18, where washer 57 is mounted in view of the end cap 20. The resistance exercise machine is designed to be used to strengthen muscles in male and female bodies.

Returning to the cup-shaped membranes 52 and 54, the cup-shaped membranes 52 produces compression in chamber section 7 when the piston is moved toward the second end 4*b* correspondingly the cup membrane 54 causes a partial vacuum (i.e., rarefaction) to developed in chamber section 5 resulting in resistance training during the full cycle of motion. In FIG. 2 the piston has opposing crescent shaped flexible members 53 and 54; they could however be o-rings mounted on the cylindrical surfaces of the disc 46.

The operation of the RTD 2 will now be explained. Adduction and abduction exercise of muscles in the chest and arm areas are to be performed with handles 18 and 22 held with the RTD 2 central axis perpendicular to a plane that includes the midline of the vertical body. The orifices of valves 6*a* and 6*b* should be set to a level that results in doable exertion rate by the user by measuring the indicated force on gauge 26 and 27. Rowing exercises should be performed by placing handle 22 on a surface and placing one foot or both feet into the eye of the handle and lifting upward with one or both hands, The chamber walls of the RTD are designed to resist a pressure of greater than 400 psig.

We claim:

1. A resistance training device comprising:

a fluid filled dual volume system having at least one essentially closed end;

a slidable piston element designed to produce compression and rarefaction within the separate volumes of said fluid filled dual volume system;

Translational motion means extending through said at least one essentially closed end of said dual volume system attached to said slidable piston element for producing the sliding motion of the slidable piston element;

at least one valve and one gauge means connected to the fluid filled dual volume system for controlling and monitoring the pressure in the interior of the fluid filled dual volume system;

and, a diverter valve connected to said at least one valve for controlling the flow of air from a volume of said dual volume system wherein the air is undergoing compression so as to allow the air leaving the valve to be exhausted into the surrounding atmosphere or to enable it to continue to flow toward at least one valve upstream of a volume of the dual volume system where the air is simultaneously undergoing rarefaction.

2. The invention of claim 1 where the slidable piston comprises: a solid cylinder with a throughhole; cup shaped flexible elements mounted on opposing ends of the cylindrical disc; and, a low friction cylindrical disc mounted on the surface of the slidable piston.

3. A resistance training device comprising:

a fluid filled dual volume system;

a slidable piston element designed to simultaneously produce compression and rarefaction within separate volumes of said fluid filled dual volume system;

a rod extending through one essentially closed end of the fluid filled dual volume system, having first and second terminal ends, with second terminal end attached to said slidable piston for producing the sliding motion in the slidable piston element and the first terminal end of said rod connected to a handle;

a diverter valve connected to valves associated with the first and second terminal ends of the fluid filled dual volume system for controlling the flow of fluid into and out of the separate volumes of the fluid filled dual volume system while essentially preventing the egress or ingress of air from the surrounding atmosphere into the interior of the fluid filled dual volume system; and, means connected to at least one end of the fluid filled dual volume system that will enable the apparatus to be used in abduction and adduction muscle exercises.

4. The apparatus of claim 3 wherein said means connected to at least one end of the fluid filled dual volume system promotes abduction and adduction muscle exercises by way of a graspable handle that may be controlled by either a foot or a hand.

* * * * *